United States Patent [19]

Smith

[11] Patent Number: 4,513,913

[45] Date of Patent: Apr. 30, 1985

[54] REVERSIBLE AIRLESS SPRAY NOZZLE

[75] Inventor: David H. Smith, Redwood City, Calif.

[73] Assignee: Binks Manufacturing Company, Franklin Park, Ill.

[21] Appl. No.: 440,502

[22] Filed: Nov. 10, 1982

[51] Int. Cl.[3] ..... B05B 15/02

[52] U.S. Cl. ..... 239/119

[58] Field of Search ..... 239/106, 119, 391, 397, 239/600

[56] References Cited

U.S. PATENT DOCUMENTS

| | | | |
|---|---|---|---|
| 2,248,395 | 7/1941 | Taper et al. | 239/119 |
| 3,563,463 | 2/1971 | Walker | 239/119 |
| 3,980,238 | 9/1976 | Adiletta | 239/590.3 |
| 4,074,857 | 2/1978 | Calder | 239/119 |
| 4,157,163 | 6/1979 | Pinto et al. | 239/119 |
| 4,165,836 | 8/1979 | Eull | 239/119 |

FOREIGN PATENT DOCUMENTS

| | | | |
|---|---|---|---|
| 2079184 | 1/1982 | United Kingdom | 239/119 |

*Primary Examiner*—Andres Kashnikow
*Assistant Examiner*—Kevin Patrick Weldon
*Attorney, Agent, or Firm*—Gary, Juettner & Pyle

[57] ABSTRACT

A reversible airless nozzle for a spray gun comprises an adapter mounted on a forward end of the gun, a filter in the adapter and an airless spray tip captured between the adapter and a safety cap. Should a small outlet orifice from the spray tip become plugged, it may be cleared by inserting the spray tip into the forward end of the adapter in the direction reverse to that for normal spraying, and then briefly triggering the spray gun to eject the blockage. The spray tip is carried in a housing adapted for a snug fit into the forward end of the adapter during cleaning, and an insert in the housing prevents the spray tip from being forced from the housing when reverse hydraulic pressures are applied.

6 Claims, 2 Drawing Figures

REVERSIBLE AIRLESS SPRAY NOZZLE

BACKGROUND OF THE INVENTION

The present invention relates to spray tip assemblies for airless spray paint equipment, and in particular to a spray tip assembly that is reversible for cleaning.

Airless spray guns are employed to spray paints and other fluidic materials in a precise spray pattern. Material is supplied to the gun under very high pressure, and when the gun is triggered on the material is hydraulically forced through a small orifice in a spray tip that is typically formed of a wear resistant material such as tungsten carbide. The orifice is specially formed and usually elliptical in shape, such that emitted material is hydraulically atomized into a fan-shaped spray.

A difficulty encountered with airless spray guns is that solids in the liquid are forced into the orifice of the spray tip and trapped therein, clogging the orifice. If the spray tip is reversed on the gun, the high pressure liquid can be used to blow the obstruction from the orifice, and a number of devices have been designed to facilitate reversal of the spray tip for this purpose. One such device is a turret nozzle unit described in U.S. Pat. No. 3,116,882, in which the spray tip is mounted in a spherical housing between compressed seals to permit its rotation for reversal. Another design is shown in U.S. Pat. No. 3,563,463, in which the spray tip is carried in a housing secured to an adapter on the end of a spray gun by a collar having a transverse slot to permit the spray tip to be removed and reversed in position. In U.S. Pat. No. 3,460,757, a spray tip is carried in a housing having an externally threaded forward portion, and a separate adapter can be turned onto the threaded portion to couple the spray tip assembly to the gun in its reverse direction. A further solution is shown in U.S. Pat. No. 4,074,857, wherein a spray tip assembly is reversible within a cylindrical barrel housing which mounts it on a forward end of a spray gun.

A difficulty encountered with prior designs which permit reversing the spray tip on the spray gun is that the devices require a substantial number of parts, resulting in a greater initial cost and maintenance requirement. Additionally, many require substantial manipulation and disassembly both in reversing the spray tip and then returning it to its forward position, and often the hydraulic forces directed against the spray tip when it is reversed cause destruction of the same.

OBJECT OF THE INVENTION

The primary object of the invention is to provide a reversible airless spray nozzle assembly for a spray gun, which has a minimal number of parts, is readily manipulatable to place an airless spray tip in either a forward or reverse position and protects the spray tip against damage from hydraulic pressures when it is in the reversed position.

SUMMARY OF THE INVENTION

In accordance with the present invention, a reversible airless nozzle for a spray gun comprises an adapter mounted on a forward end of the gun, a filter in the adapter and an airless spray tip captured between the adapter and a safety cap. Should a small outlet orifice from the spray tip become plugged, it may be cleared by inserting the spray tip into the forward end of the adapter in the direction reverse to that for normal spraying, and then briefly triggering the spray gun to eject the blockage. The spray tip is carried in a housing adapted for a snug fit into the forward end of the adapter during cleaning, and an insert in the housing prevents the spray tip from being forced from the housing when reverse hydraulic pressures are applied.

The foregoing and other objects, advantages and features of the invention will become apparent upon a consideration of the following detailed description, when taken in conjunction with the accompanying drawings.

DETAILED DESCRIPTION

Figure 1:
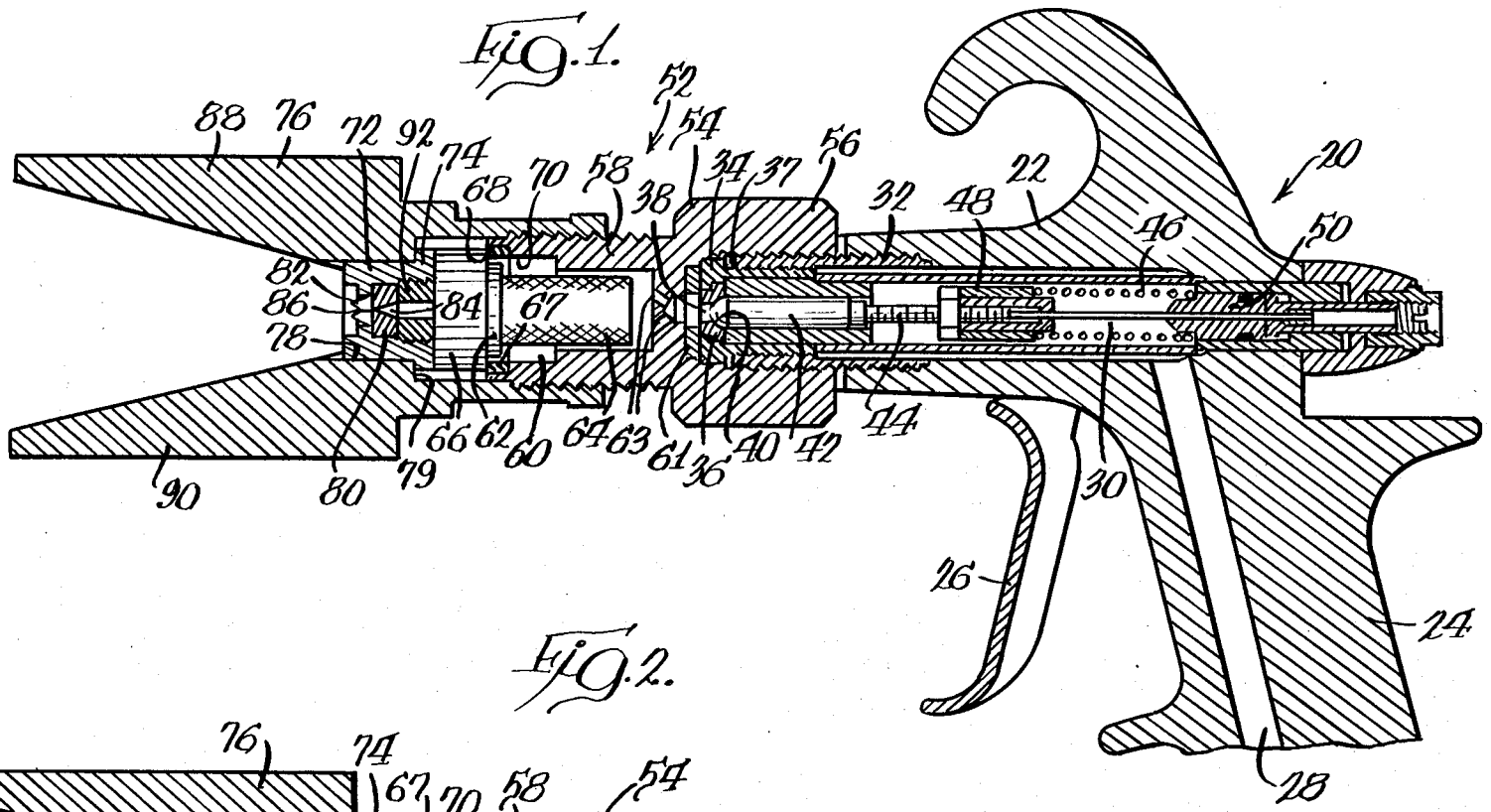
FIG. 1 is a cross sectional side elevation view of a spray gun having a reversible airless nozzle assembly configured in accordance with the teachings of the present invention, showing a spray tip member of the assembly in a forward position for emitting a spray of atomized coating material.

Referring to FIG. 1, an airless spray gun is indicated generally at 20. The gun includes a body portion 22 having a handle 24 and a trigger 26 pivotally connected (not shown) to the body. A passage 28 in the handle receives fluidic material under pressures of from about 500–2500 psi, and communicates with a chamber 30 extending longitudinally in the body. The forward end of the chamber is internally threaded, and an externally threaded tubular member 32 extends partially into the chamber.

A valve housing 34 carrying a valve member 36 is threaded into a forward end of the tubular member 32 and a seal 37 forms a fluid tight connection therebetween. The valve member has a passage 38 therethrough defining a seat 40 at its inner end, and a valve 42 carried on a stem 44 is normally urged against the seat by a spring 46 extending between flange means 48 on the stem and an insert 50 at the rearward end of the chamber 30. Although not shown, the trigger 26 is coupled with the stem, whereby upon movement of the trigger toward the handle 24 and actuation of the gun, the valve is withdrawn from the seat for a flow of material through the passage 38.

To the extent described the spray gun is conventional, and its particular structure for accommodating selective supply of fluidic material through the valve member passage 38 is not relevant to the present invention. In improving upon such conventional spray guns, however, the invention contemplates providing a reversible airless spray nozzle assembly, indicated generally at 52, at the forward end of the gun in communication with the passage 38. To that end, the nozzle assembly includes a tubular adapter 54 having an internally threaded rearward end 56 and an externally threaded forward end 58. The adapter defines a chamber 60 therein, and is threadably connected at its rearward end with the forward end of the tubular member 32. A seal 61 forms a fluid tight connection between the adapter and the valve housing 34, whereby the passage 38 communicates with the chamber through a pair of divergent passages 63 formed through a rearward wall of the adapter. Normally carried within and at a forward end of the adapter is a filter element 62, which includes a rearward porous filter section 64 disposed within the chamber 60 and a forward plastics or nylon cylindrical mounting element 66 abutted against a seal 67 within a cylindrical end 68 of the chamber, and a smaller diameter cylindrical chamber portion 69 communicates with the end 68. The filter mounting element has a passage therethrough in communication with the interior of the filter section 64, whereby upon actuation of the spray gun and introduction of coating material into the chamber, material flows through the filter.

To atomize the material into a spray, a spray tip housing 72 having a cylindrical forward end and a radial flange 74 at its rearward end is captured between the filter mounting element 66 and a safety cap 76 threadably connected at its rearward end with the adapter. The radial flange has a diameter about the same as that of the filter mounting element and seals against the element, and the diameter of the forward end of the spray tip housing is about the same as and received within a cylindrical portion 78 of a passage through the safety cap. A shoulder 79 is defined in the passage through the cap, the radial flange of the spray tip housing is held by the shoulder against the filter mounting element, and the spray tip housing has a passage therethrough and carries within the passage a spray tip 80 of conventional design and configuration. The spray tip 80 is formed of a cylindrical stock of a suitable wear resistant material such as tungsten carbide, and its front face is formed into an extension 82. A passage 84 in the form of a tapered bore extends from the rear face of the spray tip to a transverse slot 86 cut across the extension to define an orifice, and as is understood in the art the passage, the slot and the juncture therebetween are specially formed, so that material flowing through the passage and slot is hydraulically atomized into a fan-shaped spray. Consequently, upon actuation of the gun, material flows through the passage 38 and the chamber 60, and thence through the filter element and the spray tip for being emitted in a spray.

Although the material emitted from the spray tip 80 is atomized into a spray, atomization occurs a discrete distance from the spray tip, and until atomization occurs the fluid is under a pressure and at a velocity sufficient to penetrate the skin of a user of the gun. Consequently, the safety cap 76 is provided to protect an operator of the gun, and to that end includes a pair of winglike elements 88 and 90 extending forwardly from the spray tip to prevent physical contact with emitted fluid close to the spray tip.

In use of the spray gun, despite the filter 62 it occasionally happens that solids in the liquid are forced into the orifice of the spray tip 80 and are trapped therein, clogging the orifice. When this occurs, the spray pattern is disrupted and the orifice must be cleared. Although the spray tip is formed of carbide or a similarly hard material, it is nevertheless susceptible to damage if a relatively hard object such as a thin wire is used to remove the blockage. The art therefore contemplates that the spray tip be reversed, so that fluid under pressure may be flowed through the tip in the reverse direction to remove the blockage. Unfortunately, with conventional designs of reversible spray nozzles, reverse hydraulic pressures on the spray tip often result in it being dislodged from the housing in which it is mounted, thereby destroying its usefulness.

The invention therefore also contemplates that the spray tip 80 be securely mounted within the spray tip housing 72, so that it is not susceptible to being forced from the housing upon application of reverse hydraulic pressures. To this end, an insert 92 is provided in the passage through the spray tip housing rearwardly of and abutting the spray tip, thereby to securely maintain the spray tip in position within the housing and to prevent it from being forced therefrom by reverse hydraulic pressures. The insert, which has a passage for a flow of fluid therethrough, may be permanently affixed within the housing or, as shown, threaded therein so that it may be removed to accommodate replacement of the spray tip.

Figure 2:
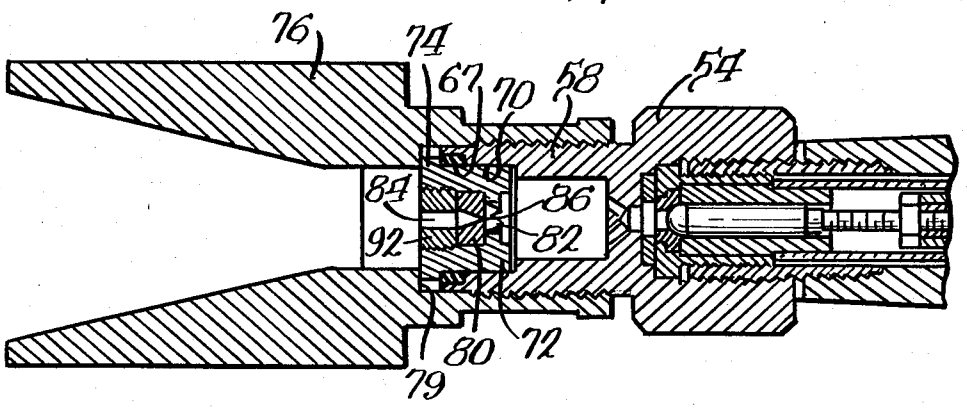
FIG. 2 is a cross sectional side elevation view of the nozzle assembly, showing the spray tip member in reverse position for being cleaned by a reverse flow of material therethrough.

Accordingly, the spray tip 80 may conveniently be reversed for cleaning of its orifice, and FIG. 2 illustrates the tip in reversed position. This position is arrived at from the operating position shown in FIG. 1 by loosening and removing the safety cap 76 from the forward end of the adapter 54, and then removing the filter 62 from the adapter. The spray tip housing 72 is then extended front end first into the cylindrical passage portion 70 in the adapter, the inner diameter of which is about the same as the forward end of the housing for snug receipt thereof, and the safety cap replaced on the adapter. This positions the spray tip 80 in reverse orientation with respect to a flow of fluid through the gun, with the spray tip housing being held in place by means of the radial flange 74 being captured between the shoulder 79 in the safety cap passage and the seal 67 at the forward end of the adapter. Solid material lodged within the spray tip orifice can then readily be dislodged by briefly triggering the gun on to cause a reverse flow of liquid under pressure through the orifice. At the same time, because of the insert 92, upon application of reverse hydraulic pressures the spray tip is not dislodged from its housing.

The invention thus provides an improved reversible airless spray nozzle assembly for a spray gun. Because the spray tip is securely held within its housing, upon reversing thereof the tip cannot be dislodged from the housing upon application of reverse hydraulic pressures thereto. At the same time, no additional components are required for the reversing operation over and above those required incident to normal spraying, and because of the configurations of the adapter and safety cap and their interaction with the spray tip housing, the spray tip housing is always securely maintained within the spray nozzle assembly irrespective of whether it is in its normal or reversed position.

While one embodiment of the invention has been described in detail, various modifications and other embodiments thereof may be devised by one skilled in the art without departing from the spirit and scope of the invention, as defined in the appended claims.

What is claimed is:

1. A spray nozzle assembly for reversible mounting on an airless spray gun, comprising an adapter for sealed connection at a rearward end thereof with a forward fluid outlet end of the spray gun, said adapter having external threads at a forward end thereof and a passage therethrough defining a first passage section of a first diameter toward said adapter forward end; annular seal means at said adapter forward end; a cap having a passage therethrough and internal threads in a rearward end of said passage for connection with said adapter forward end, said cap passage forwardly of said threads defining a second passage section of a second diameter and a third passage section forwardly of said second section and having substantially said first diameter, said first diameter being less than said second and said second and third passage sections defining a shoulder therebetween; a spray tip assembly including a generally cylindrical housing having a passage extending axially therethrough and a radially outwardly extending annular flange at a rearward end thereof, and a spray tip in a forward end of said housing passage and having a bore therethrough terminating in a fluid outlet orifice at a forward end of said spray tip, said flange having a diameter greater than said first diameter and the portion of said housing forwardly of said flange having substantially said first diameter, said spray tip assembly in normal spraying position being positioned with said cylindrical housing portion forwardly of said flange received in said cap third passage section and said flange received in said cap second passage section, said spray tip assembly being reversible for cleaning a blockage from said orifice by a reverse flow of fluid therethrough and when reversed being positioned with said cylindrical housing portion forwardly of said flange received in said adapter first passage section and said flange captured between said shoulder and said seal means; and a filter comprising a cylindrical body of filter material having a diameter less than said first diameter and a cylindrical mounting member at an end thereof, coaxial with and attached to said body of filter material and having a passage therethrough and a diameter greater than said first diameter, said filter, when said spray tip assembly is in normal position for spraying, being positioned with said filter material body extended into said first passage section and said cylindrical mounting member captured between said seal means and a rearward end of said spray tip assembly housing flange with a forward end of said flange abutting said shoulder, said cylindrical mounting member being of a resilient material and forming a seal with said housing flange, and said filter, when said spray tip assembly is in reverse position for cleaning, being removed from said adapter.

2. A spray nozzle assembly as in claim 1, wherein said forward end of said spray tip assembly housing passage has a radially inwardly extending annular flange and said spray tip comprises a cylindrical body, of substantially the same diameter as said housing passage, received in said housing passage abutting said inwardly extending flange and having a forward portion extending through said flange, said bore extending through said cylindrical body and into said forward portion and said orifice being formed in said forward portion, and including a tubular insert in said housing passage rearwardly of and abutting said cylindrical body for maintaining said spray tip in said housing passage upon application of hydraulic pressures thereto when said spray tip assembly is reversed for cleaning said orifice.

3. A spray nozzle assembly as in claim 1, wherein said adapter passage has a fourth passage section at the very forward end thereof and having a diameter greater than said first diameter, and said seal means comprises said filter cylindrical mounting member and an annular seal in said fourth passage section, said annular seal having an inner diameter substantially equal to said first diameter.

4. A spray nozzle assembly as in claim 3, wherein said filter cylindrical mounting member has a diameter slightly less than that of said annular seal and substantially the same as that of said spray tip assembly housing flange.

5. A spray nozzle assembly as in claim 2, wherein said insert is threaded into said housing passage.

6. A spray nozzle assembly as in claim 2, wherein said cap includes a pair of wing-like members forwardly of and diverging outwardly from said spray tip orifice for protecting an operator of the spray gun from close proximity with fluid emitted through said orifice.

* * * * *